US011316301B2

(12) United States Patent
Yu

(10) Patent No.: US 11,316,301 B2
(45) Date of Patent: Apr. 26, 2022

(54) ELECTRICAL CONNECTION ASSEMBLY

(71) Applicant: NINGBO WELL ELECTRIC APPLIANCE CO., LTD., Ningbo (CN)

(72) Inventor: Guolin Yu, Ningbo (CN)

(73) Assignee: NINGBO WELL ELECTRIC APPLIANCE CO., LTD., Ningbo (CN)

( * ) Notice: Subject to any disclaimer, the term of this patent is extended or adjusted under 35 U.S.C. 154(b) by 13 days.

(21) Appl. No.: 16/922,776

(22) Filed: Jul. 7, 2020

(65) Prior Publication Data

US 2021/0296823 A1 Sep. 23, 2021

(30) Foreign Application Priority Data

Mar. 20, 2020 (CN) ..... 202010200583.8
Mar. 20, 2020 (CN) ..... 202020367900.0

(51) Int. Cl.
*H01R 13/62* (2006.01)
*H01R 13/639* (2006.01)
*H01R 13/502* (2006.01)

(52) U.S. Cl.
CPC ..... *H01R 13/639* (2013.01); *H01R 13/502* (2013.01)

(58) Field of Classification Search
CPC ..... H01R 13/6392; H01R 13/6395; H01R 13/6275; H01R 13/20; H01R 13/639; H01R 13/562; H01R 13/6276; H01R 13/502
USPC ..... 439/367–369, 371, 373, 345–348, 445
See application file for complete search history.

(56) References Cited

U.S. PATENT DOCUMENTS 1,665,095 A * 4/1928 Henry ..... H01R 13/639 439/372
2,753,536 A * 7/1956 Tjader ..... H01R 13/6392 439/369
3,475,716 A * 10/1969 Laig ..... H01R 13/6392 439/369
5,306,176 A * 4/1994 Coffey ..... H01R 13/6392 439/367
5,785,547 A * 7/1998 Cross ..... H01R 13/6392 439/369
5,876,234 A * 3/1999 Hester ..... H01R 13/6392 439/369
5,913,693 A * 6/1999 Fetterolf ..... H01R 13/6392 439/369
6,080,004 A * 6/2000 Kovacik ..... H01R 13/6392 439/352

(Continued)

*Primary Examiner* — Thanh Tam T Le

(57) ABSTRACT

An electrical connection assembly includes a first electrical member and a locking structure configured to lock the first electrical member to a second electrical member cooperating with the first electrical member. An adjusting sleeve is sheathed on an outer surface of the first electrical member and movable along an axis of the first electrical member. A collar is sheathed on an outer surface of the adjusting sleeve. A connecting bracket is rotatably connected to the collar. The second electrical member includes a first end coupled to the first electrical member and a second end opposite to the first end. The connecting bracket is rotatable to the second end of the second electrical member for limiting the second end of the second electrical member.

11 Claims, 6 Drawing Sheets

(56) References Cited

U.S. PATENT DOCUMENTS

| | | | | | |
|---|---|---|---|---|---|
| 6,135,803 | A * | 10/2000 | Kovacik | H01R 13/62 | 439/369 |
| 6,171,132 | B1 * | 1/2001 | Schmidt | F16L 57/00 | 439/367 |
| 6,196,859 | B1 * | 3/2001 | Garlarza | H01R 13/6395 | 439/369 |
| 6,478,601 | B2 * | 11/2002 | Oswald | H01R 13/6397 | 439/369 |
| 6,997,734 | B1 * | 2/2006 | McQuirter | H01R 13/6392 | 439/369 |
| 7,186,130 | B1 * | 3/2007 | Miller | H01R 13/639 | 439/369 |
| 7,407,405 | B1 * | 8/2008 | Slenczka | H01R 13/6392 | 439/369 |
| 7,438,579 | B1 * | 10/2008 | Pellen | H01R 13/622 | 439/312 |
| 7,509,956 | B2 * | 3/2009 | Dombrowski | A61M 16/0488 | 128/202.27 |
| 7,988,484 | B1 * | 8/2011 | Jacoby | H01R 13/6392 | 439/369 |
| 8,328,574 | B1 * | 12/2012 | Lin | H01R 13/639 | 439/321 |
| 8,337,236 | B2 * | 12/2012 | Shu | H01R 13/6395 | 439/369 |
| 8,535,082 | B2 * | 9/2013 | Lifson | H01R 13/6392 | 439/369 |
| 9,077,111 | B2 * | 7/2015 | Brown | G02B 6/4452 | |
| 10,141,690 | B2 * | 11/2018 | Bozikis | H01R 13/6392 | |
| 10,148,038 | B2 * | 12/2018 | Cunningham | H01R 13/639 | |
| 10,374,359 | B1 * | 8/2019 | Dong | H01R 43/26 | |
| 10,944,212 | B1 * | 3/2021 | Chen | H01R 13/20 | |

* cited by examiner

ELECTRICAL CONNECTION ASSEMBLY

CROSS-REFERENCE TO RELATED APPLICATIONS

This application claims all benefits accruing under 35 U.S.C. § 119 from China Patent Application Nos. 202020367900.0, filed on Mar. 20, 2020, and 202010200583.8, filed on Mar. 20, 2020, in the China National Intellectual Property Administration, the content of which is hereby incorporated by reference.

TECHNICAL FIELD

The present disclosure generally relates to electrical connection, and in particular, to an electrical connection assembly.

BACKGROUND

An electrical plug and an electrical socket are common electrical connection assemblies. At present, a common electrical socket usually includes a pressing element which can press a pin of the electrical plug, so that the electrical plug and the electrical socket can be locked. The pin of the electrical plug may have a small locking force and poor stability between the electrical plug and the electrical socket. Moreover, the pressing element that press on the pin is usually located on the electrical socket, so the overall structure of the pressing element and the electrical socket is small and not convenient for a user to operate.

SUMMARY

Thus, it is desired to provide an electrical connection assembly to solve the above problems in the prior art.

Specifically, an embodiment of the present disclosure can include a first electrical member and a locking structure, and the locking structure can be configured to lock the first electrical component to a second electrical component cooperating with the first electrical component. The locking structure can include an adjustment sleeve sheathed on an outer surface of the first electrical member and be able to move along an axis of the first electrical member; a collar sheathed on an outer surface of the adjusting sleeve; and a connecting bracket rotatably connected to the collar. The second electrical member can include a first end coupled to the first electrical member and a second end opposite to the first end, and the connecting bracket can rotate to the second end of the second electrical member for limiting the second end of the second electrical member. When the adjusting sleeve rotates relative to the first electrical member and the collar around the axis of the first electrical member and away from the first end of the second electrical member, the adjusting sleeve, the collar, and the connecting bracket move along the axis of the first electrical member and away from the first end of the second electrical member, resulting in the first end of the second electrical member locking to the first electrical member.

Furthermore, the adjusting sleeve can include a sleeve body whose outer surface is provided with a first blocking member and a second blocking member, and the first blocking member and the second blocking member can abut against both sides of the collar respectively to limit the collar to the sleeve body of the adjusting sleeve.

Furthermore, the first blocking member can include a retaining ring which is formed by an end of the sleeve body of the adjusting sleeve near the first end of the second electrical member protruding in a radial direction of the adjusting sleeve.

Furthermore, the second blocking member can include a plurality of bulges located on an outer surface of the sleeve body.

Furthermore, the retaining ring can have a plurality of gaps.

Furthermore, the sleeve body can be threadably sheathed on an outer surface of the first electrical member.

Furthermore, the sleeve body can be provided with a plurality of strips, and the plurality of strips can be arranged on the outer surface of the sleeve body along an axis of the sleeve body of the adjusting sleeve.

Furthermore, the sleeve body, the first blocking member and the second blocking member can be an integral structure.

Furthermore, the collar can include a first portion and a second portion cooperating with the first portion, and the first portion and the second portion can have two ends respectively each of which is equipped with a connecting convex hook, and the connecting bracket can be rotatably connected to the first portion and the second portion by the connecting convex hook.

Furthermore, a concave-convex structure can be provided between the first portion and the second portion, and the concave-convex structure can be configured to prevent a relative movement between the first portion and the second portion.

Furthermore, a fastener can be provided at an end of the connecting bracket away from the collar, and the fastener can be configured to limit the second end of the second electrical member to the connecting bracket.

The electrical connection assembly of the present embodiment has the following advantages. The second end of the second electrical member can be limited by the connecting bracket, and the adjusting sleeve can rotate relative to the first electrical member and the collar. When the adjusting sleeve rotates relatively to the first electrical member and the collar around the axis of the first electrical member and away from the first end of the second electrical member, the adjusting sleeve, the collar, and the connecting bracket move along the axis of the first electrical member and away from the first end of the second electrical member. The first end of the second electrical member will be tightly locked to the first electrical member. That is, the collar and the connecting bracket can be moved by the adjusting sleeve, and rotation of the adjusting sleeve will ensure tight locking of the second electrical member and the first electrical member. The operation of the locking structure is easy, which is convenient for the user.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

Unless otherwise defined, all technical and scientific terms used herein have the same meaning as a skilled person in the art would understand. The terminology used in the description of the present disclosure is for the purpose of describing particular embodiments and is not intended to limit the disclosure.

Figure 1:
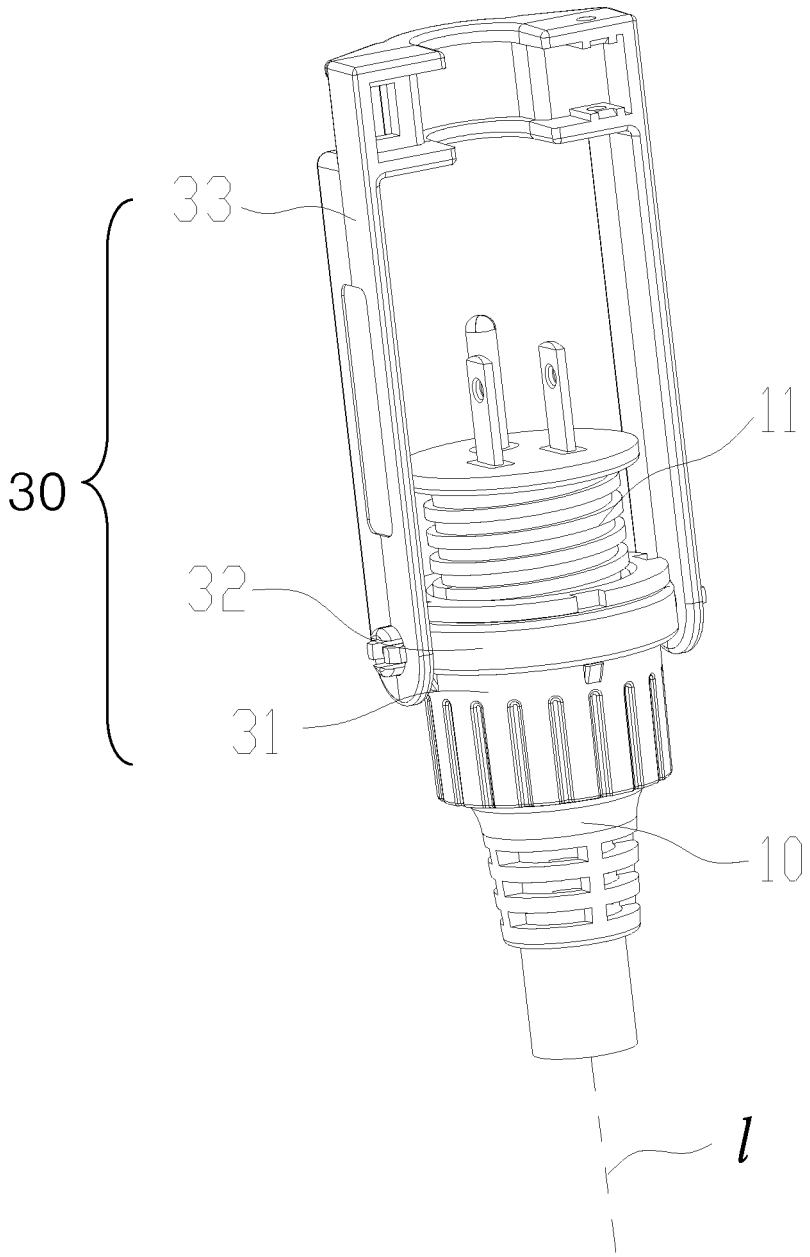
FIG. 1 is a perspective view of an electrical connection assembly according to an embodiment of the present disclosure.

Referring to FIG. 1, an embodiment of the present disclosure can include a first electrical member 10 and a locking structure 30. The locking structure 30 can be configured to lock the first electrical member 10 to a second electrical member cooperating with the first electrical member 10 in order to prevent the first electrical member 10 from detaching from the second electrical member.

In this embodiment, the locking structure 30 can include an adjusting sleeve 31 sheathed on an outer surface of the first electrical member 10, a collar 32 sheathed on an outer surface of the adjusting sleeve 31, and a connecting bracket 33 rotatably connected to the collar 32. The adjusting sleeve 31 can rotate relative to the first electrical member 10 and the collar 32 around an axis l of the first electrical member 10.

Figure 2:
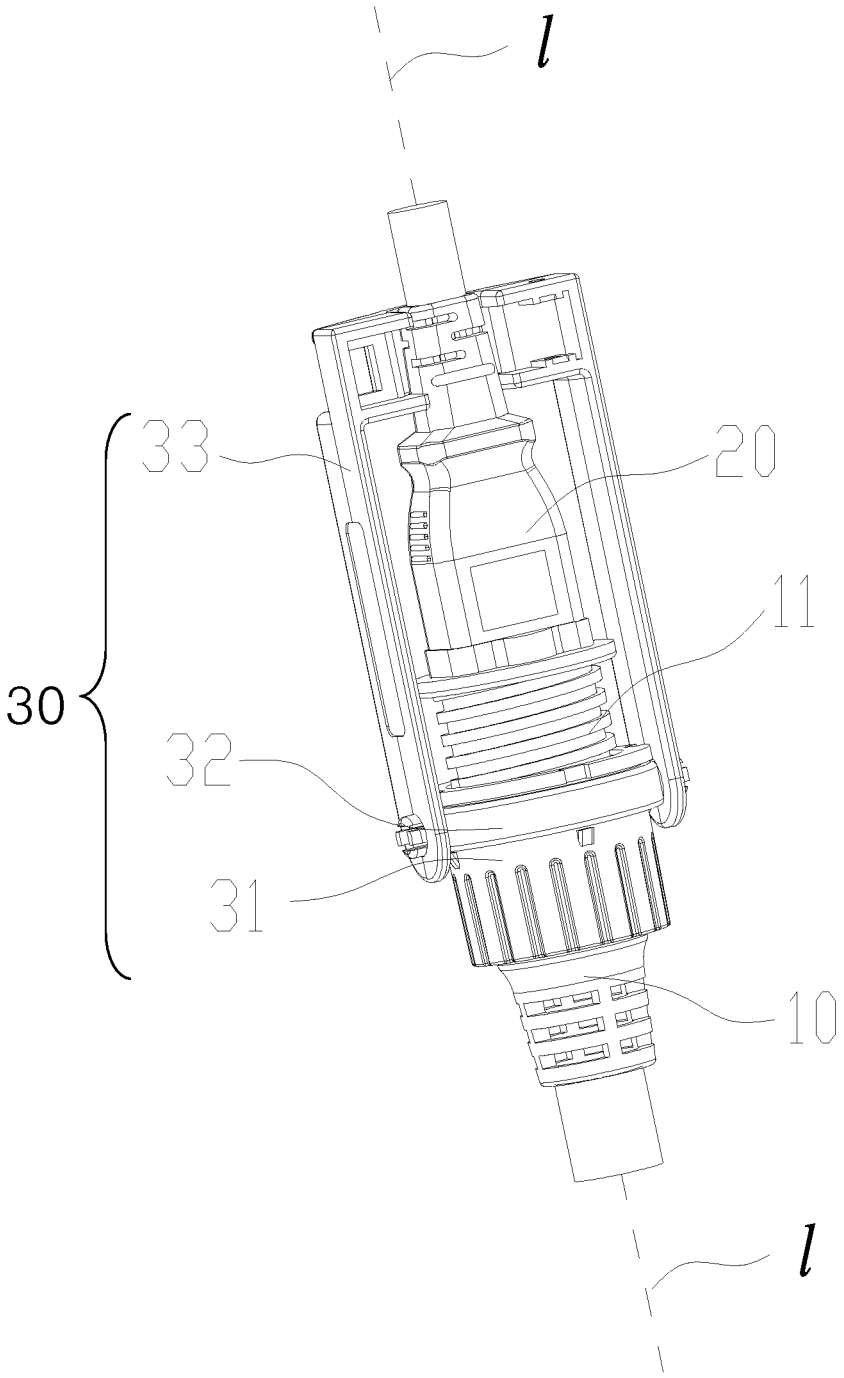
FIG. 2 is a perspective view of an electrical connection assembly according to another embodiment of the present disclosure.

In this embodiment, referring to FIG. 1 and FIG. 2, the first electrical member 10 can be an electrical plug, and the second electrical member 20 can be an electrical socket cooperating with the first electrical member 10. Alternatively, the first electrical member 10 can be an electrical socket, and the second electrical member 20 can be an electrical plug.

The second electrical member 20 can include a first end coupled to the first electrical member 10 and a second end opposite to the first end, and the connecting bracket 33 can rotate to the second end of the second electrical member 20 for limiting the second end of the second electrical member 20. When the adjusting sleeve 31 rotates relative to the first electrical member 10 and the collar 32 around the axis l of the first electrical member 10, it can move along the axis l of the first electrical member 10 and away from the first end of the second electrical member 20, as can the collar 32 and the connecting bracket 33. Due to the second end of the second electrical member 20 being limited to the connecting bracket 33, a movement of the collar 32 and the connecting bracket 33 can result in the first end of the second electrical member tightly locked to the first electrical member 10.

Figure 3:
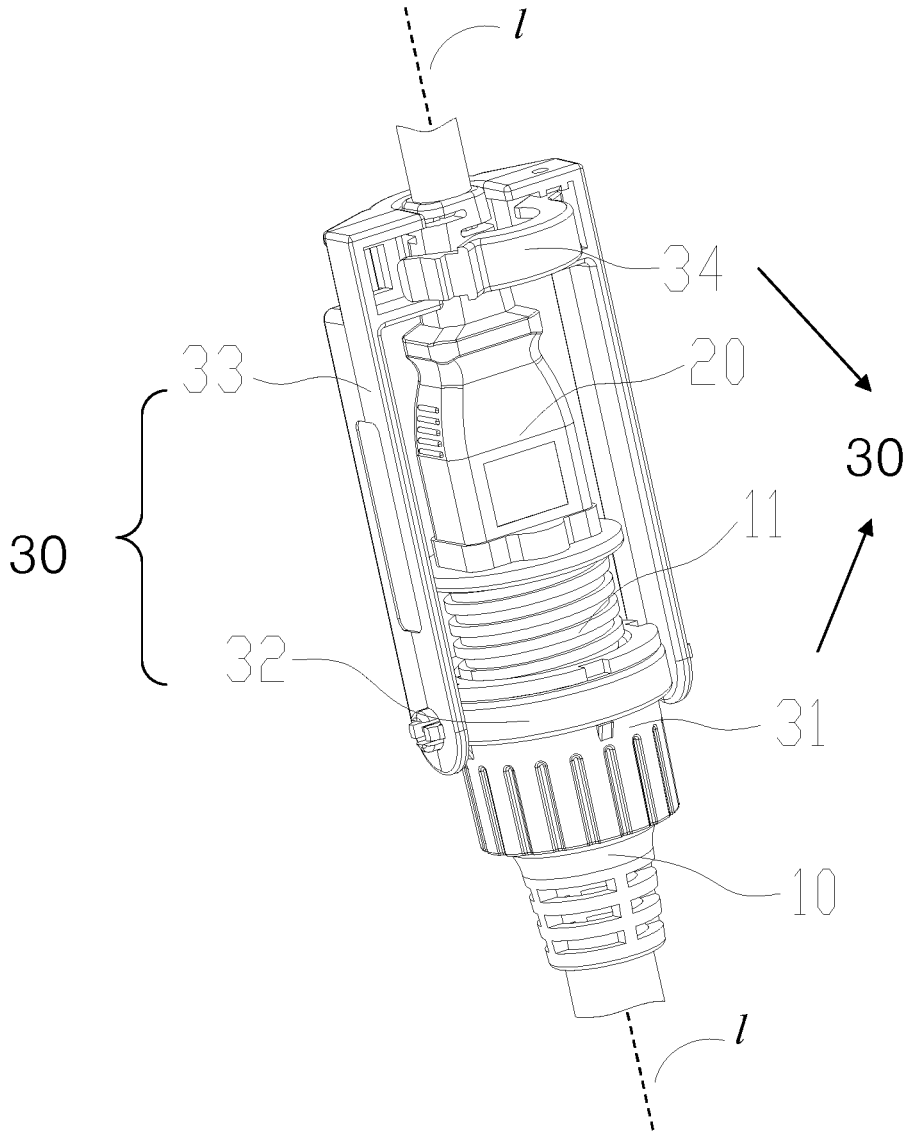
FIG. 3 is a perspective view of an electrical connection assembly according to another embodiment of the present disclosure.

In some embodiments, referring to FIG. 3, the locking structure 30 can further include a fastener 34 provided at an end of the connecting bracket 33 away from the collar 32. The fastener 34 can be configured to limit the second end of the second electrical member 20 to the connecting bracket. Specifically, the fastener 34 is hinged on the end of the connecting bracket 33 away from the collar 32.

Figure 4:
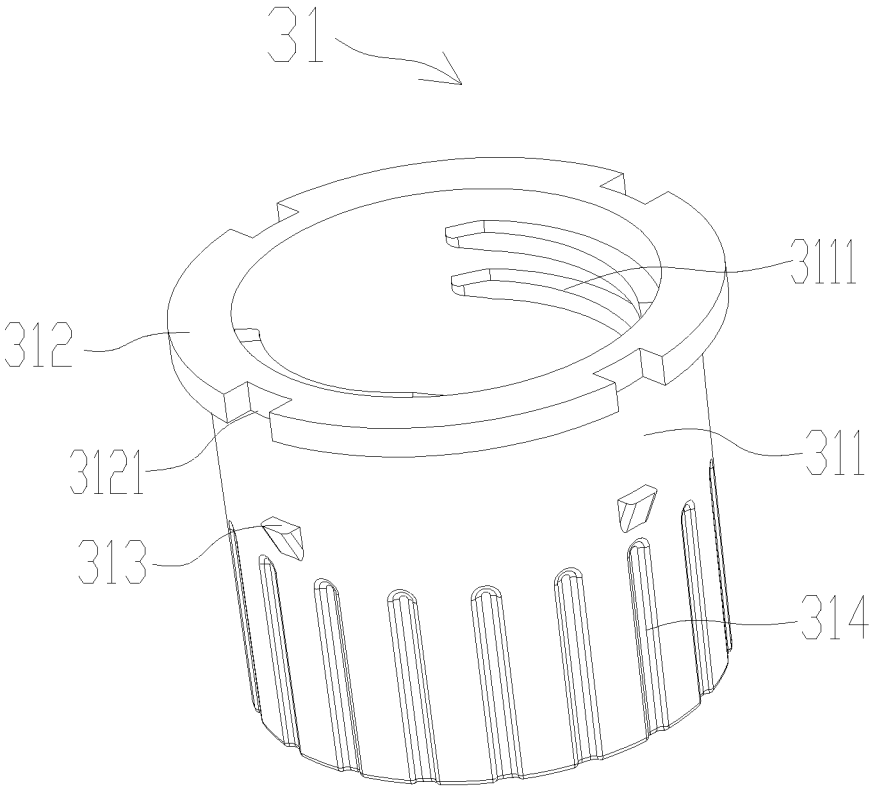
FIG. 4 is a perspective view of an adjusting sleeve of the electrical connection assembly of FIG. 1.

Referring to FIG. 4, the adjusting sleeve 31 can include a sleeve body 311 whose outer surface is provided with a first blocking member 312 and a second blocking member 313. The first blocking member 312 and the second blocking member 313 can abut against both sides of the collar 32 respectively to limit the collar 32 to the sleeve body 311 of the adjusting sleeve 31, so as to achieve the assembly connection between the collar 32 and the adjusting sleeve 31.

It is understood that the collar 32 of the present embodiment can be sheathed between the first blocking member 312 and the second blocking member 313 on the sleeve body 311, and the collar 32 can have a clearance fit with the first blocking member 312 and the second blocking member 313 to rotate relatively to the sleeve body 311. Therefore, when the adjusting sleeve 31 rotates around the axis of the first electrical member, the collar 32 will move along the axis of the first electrical member 10, resulting in the connecting bracket 33 moving along the axis of the first electrical member 10 toward or away from the first electrical member, which enables a locking state or an unlocking state of the first electrical member 10 and the second electrical member 20.

In some embodiments, the first blocking member 312 can include a retaining ring which is formed by an end of the sleeve body 311 of the adjusting sleeve 31 near the first end of the second electrical member 20 protruding in a radial direction of the adjusting sleeve 31. The second blocking member 313 can include a plurality of bulges located on an outer surface of the sleeve body 311. In one embodiment, the plurality of bulges are perpendicular to the sleeve body 311 and face an end face of the collar 32, thereby ensuring a limitation of the plurality of bulges to the collar 32. It should be noted that the first blocking member 312 and the second blocking member 313 are not limited to what is shown in FIG. 4, and it should be apparent to one skilled in the art that the first blocking member 312 may include one or more bulges or a convex platform with a certain curvature, and the second blocking member 313 may include a convex ring or a convex platform with a certain curvature.

In some embodiments, the retaining ring has a plurality of gaps 3121 to facilitate the manufacture of the adjusting sleeve 31. During preparation of the adjusting sleeve 31, the plurality of gaps 3121 can be configured for de-moulding the adjusting sleeve 31 from a mould. In other words, the present embodiment facilitates the manufacture of the adjusting sleeve 31 by simplifying the structure of the mould that corresponds to the production of the adjusting sleeve 31. As another example, the sleeve body 311, the first blocking member 312 and the second blocking member 313 can be an integral structure.

In some embodiments, the sleeve body 311 can be threadably sheathed on an outer surface of the first electrical member 10. For example, an inner peripheral surface of the sleeve body 311 can be provided with internal screw threads 3111, and the first electrical member 312 can be provided with external screw threads 11 which cooperate with the internal screw threads 3111. The sleeve body 311 can be threadably sheathed on an outer surface of the first electrical member 10 by the cooperation of the internal screw threads 3111 and the external screw threads 11, so that the adjusting sleeve 31 can be threadably sheathed on an outer surface of the first electrical member 10. It should be noted that a length of the internal screw threads 3111 can be set according to actual needs. Additionally or alternatively, the length of the internal screw threads 3111 can be set to be as short as possible in order to increase moving distance of the connecting bracket 33 when the adjusting sleeve 31 moves along the axis of the first electrical member 10.

Furthermore, the internal screw threads 3111 can be positioned on the sleeve body 311 corresponding to an area between the first blocking member 312 and the second blocking member 313. This can enable the adjusting sleeve 31 to move from one end of the external screw threads 11 to the other end of the external screw threads 11 by rotation, thereby ensuring that the connecting bracket 33 can be moved by the adjusting sleeve 31 to lock the first electrical member 10 and the second electrical member 20.

In some embodiments, the sleeve body 311 can be provided with a plurality of strips 314. The plurality of strips 314 can be arranged on the outer surface of the sleeve body 311 along an axis of the sleeve body 311 of the adjusting sleeve 31. In the process of rotating the adjusting sleeve 31, the hands can catch the plurality of strips 314 in order to prevent slippage, and it's convenient to rotate the adjusting sleeve 31 relative to the first electrical member 10.

As can be seen above, the collar 32 can be configured to connect the adjusting sleeve 31 and the connecting bracket 33, so that when the adjusting sleeve 31 rotates relative to the first electrical member 10, the connecting bracket 33 can move along the axis of the first electrical member 10.

Figure 5:
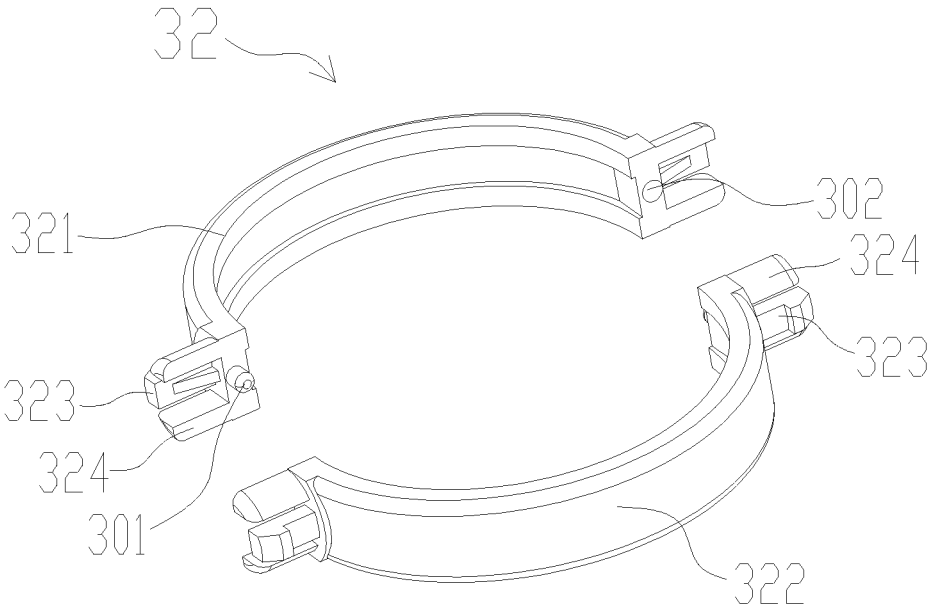
FIG. 5 is an exploded view of a collar of the electrical connection assembly of FIG. 1.
Figure 6:
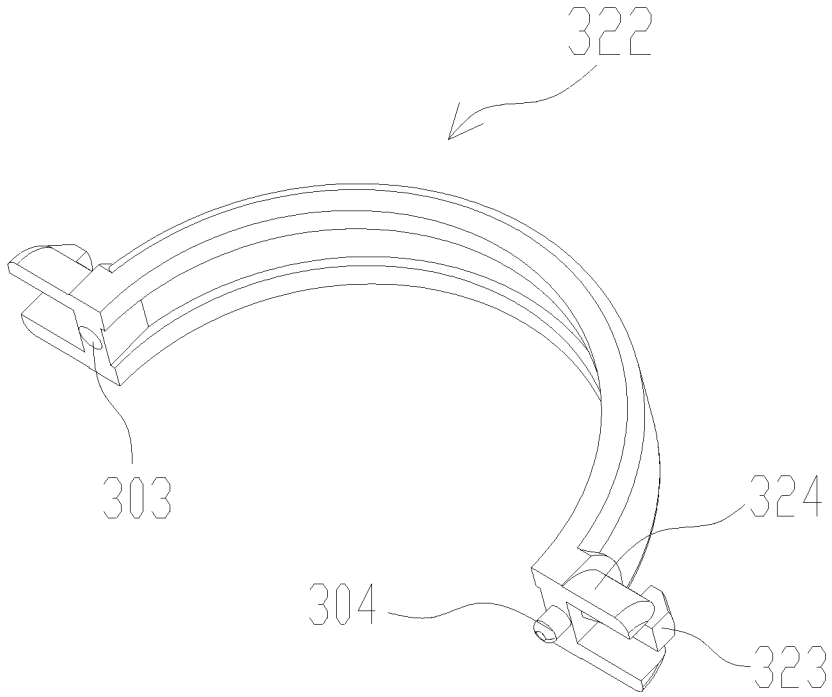
FIG. 6 is a perspective view of a second semicircular body of the electrical connection assembly of FIG. 1.

Referring to FIG. 5 and FIG. 6, the collar 32 includes a first portion 321 and a second portion 322 cooperating with the first portion 321. The first portion 321 and the second portion 322 can have two ends respectively each of which is equipped with a connecting convex hook 323. The connecting bracket 33 can be rotatably connected to the first portion 321 and the second portion 322 by the connecting convex hook 323, thereby ensuring a rotatable connection between the collar 32 and the connecting bracket 33. For example, the first portion 321 and the second portion 322 can be in a semicircular shape. It should be noted that the first portion 321 and the second portion 322 can be two portions cooperating with each other and not limited to what is shown in FIG. 5.

Specifically, when the first portion 321 cooperates with the second portion 322, a connecting convex hook 323 of the first portion 321 and a connecting convex hook 323 of the second portion 322 are configured to penetrate through the connecting bracket 33 together. The connecting convex hook 323 can include a hook portion configured for limiting the connecting bracket 33. The connecting bracket 33 can rotate around the connecting convex hook 323, so that the connecting bracket 33 can be rotatably connected to the collar 32. At the same time, the connecting bracket 33 is able to limit the two connecting convex hooks 323, thereby the first portion 321 and the second portion 322 being an integrity structure and preventing the first portion 321 and the second portion 322 from disengaging.

In some embodiments, referring to FIG. 5, a connecting convex column 324 can be provided on a circumferential direction of the connecting convex hook 323. The connecting convex column 324 can be configured to penetrate through the connecting bracket 33 together with the connecting convex hook 323, and a portion of the connecting convex hook 323 and the connecting convex column 324, which penetrates through the connecting bracket 33 can be against the connecting bracket 33, thereby improving connecting stability between the collar 32 and the connecting bracket 33. At one end of the first portion 321 or the second portion 322, the number of the connecting convex hook 323 can be one, the number of the connecting convex column 324 can be two, and the two connecting convex columns 324 can be separated on either side of the connecting convex hook 323. It should be noted that the number of the connecting convex hook 323 and the number of the connecting convex column 324 are not limited to what is shown in FIG. 5 and FIG. 6, and it should be apparent to one skilled in the art that the number of the connecting convex hook 323 can be two, the number of the connecting convex column 324 can be one; or the number of the connecting convex hook 323 and the number of the connecting convex column 324 can be set to other number such as one or two for both.

Referring to FIG. 5 and FIG. 6, a concave-convex structure can be located on ends of the first portion 321 and the second portion 322. The concave-convex structure can be configured to prevent a relative movement between the first portion 321 and the second portion 322, thereby confirming the assembly position between the first portion 321 and the second portion 322, facilitating the assembly of the first portion 321 and the second portion 322.

Specifically, the concave-convex structure can include a first convex column 301 provided on one end of the first portion 321 and a first groove 302 provided on the other end, and a second groove 303 provided on one end of the second portion 322 and a second convex column 304 provided on the other end, wherein the first convex column 301 can cooperate with the second groove 303, and the second convex column 304 can cooperate with the first groove 302. In this embodiment, the first portion 321 and the second portion 322 can be set in the same structure to facilitate the manufacture of the collar 32.

In summary, the second end of the second electrical member can be limited by the connecting bracket, and the adjusting sleeve can rotate relative to the first electrical member and the collar. When the adjusting sleeve rotates relative to the first electrical member and the collar around the axis of the first electrical member and away from the first end of the second electrical member, the adjusting sleeve, the collar, and the connecting bracket move along the axis of the first electrical member and away from the first end of the second electrical member. The first end of the second electrical member will be tightly locked to the first electrical member. That is, the collar and the connecting bracket can be moved by the adjusting sleeve, and rotating of the adjusting sleeve will ensure the tightly locking of the second electrical member and the first electrical member. The operation of the locking structure is easy, which is convenient for the user.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. An electrical connection assembly comprising a first electrical member and a locking structure configured to lock the first electrical member to a second electrical member cooperating with the first electrical member, wherein:

the locking structure comprises:

an adjusting sleeve threadably sheathed on an outer surface of the first electrical member and movable along an axis of the first electrical member;

a collar sheathed on an outer surface of the adjusting sleeve; and a connecting bracket rotatably connected to the collar, wherein the second electrical member comprises a first end coupled to the first electrical member and a second end opposite to the first end, the connecting bracket is rotatable to the second end of the second electrical member for limiting the second end of the second electrical member;

when the adjusting sleeve rotates relative to the first electrical member and the collar around the axis of the first electrical member and away from the first end of the second electrical member, the adjusting sleeve, the collar, and the connecting bracket move along the axis of the first electrical member and away from the first end of the second electrical member, resulting in the first end of the second electrical member being locked to the first electrical member.

2. The electrical connection assembly of claim 1, wherein the adjusting sleeve comprises a sleeve body whose outer surface is provided with a first blocking member and a second blocking member, and the first blocking member and the second blocking member abut against both sides of the collar respectively to limit the collar to the sleeve body of the adjusting sleeve.

3. The electrical connection assembly of claim 2, wherein the first blocking member comprises a retaining ring which is formed by an end of the sleeve body of the adjusting sleeve near the first end of the second electrical member protruding in a radial direction of the adjusting sleeve.

4. The electrical connection assembly of claim 2, wherein the second blocking member comprises a plurality of bulges located on an outer surface of the sleeve body.

5. The electrical connection assembly of claim 3, wherein the retaining ring has a plurality of gaps.

6. The electrical connection assembly of claim 2, wherein the sleeve body is threadably sheathed on an outer surface of the first electrical member.

7. The electrical connection assembly of claim 2, wherein the sleeve body is provided with a plurality of strips, and the plurality of strips are arranged on the outer surface of the sleeve body along an axis of the sleeve body of the adjusting sleeve.

8. The electrical connection assembly of claim 2, wherein the sleeve body, the first blocking member and the second blocking member are an integral structure.

9. The electrical connection assembly of claim 1, wherein the collar comprises a first portion and a second portion cooperating with the first portion, wherein the first portion and the second portion have two ends respectively, each of which end is equipped with a connecting convex hook, and the connecting bracket is rotatably connected to the first portion and the second portion by the connecting convex hook.

10. The electrical connection assembly of claim 9, wherein a concave-convex structure is provided between the first portion and the second portion, and the concave-convex structure is configured to prevent a relative movement between the first portion and the second portion.

11. The electrical connection assembly of claim 1, wherein a fastener is provided at an end of the connecting bracket away from the collar, and the fastener is configured to limit the second end of the second electrical member to the connecting bracket.

* * * * *